US006702228B2

(12) United States Patent
Zide et al.

(10) Patent No.: US 6,702,228 B2
(45) Date of Patent: Mar. 9, 2004

(54) FILM REEL

(75) Inventors: Larry M. Zide, Oak Park, CA (US); Helmut E. Dorausch, Simi Valley, CA (US)

(73) Assignee: Filmtreat West Corp., Sun Valley, CA (US)

( * ) Notice: Subject to any disclaimer, the term of this patent is extended or adjusted under 35 U.S.C. 154(b) by 0 days.

(21) Appl. No.: 10/195,299

(22) Filed: Jul. 16, 2002

(65) Prior Publication Data

US 2004/0011916 A1 Jan. 22, 2004

(51) Int. Cl.[7] ..... B65H 75/14; B65H 75/22
(52) U.S. Cl. ..... 242/608.6
(58) Field of Search ..... 242/608.6, 608.7, 242/118.6, 118.61, 608.2

(56) References Cited

U.S. PATENT DOCUMENTS 3,088,689 A * 5/1963 Perlini ..... 242/118.6
5,676,332 A * 10/1997 Kraus et al. ..... 242/608.6
5,775,634 A * 7/1998 Fettes et al. ..... 242/608.6
6,257,519 B1 * 7/2001 Willems et al. ..... 242/608.6

* cited by examiner

*Primary Examiner*—John M. Jillions
(74) *Attorney, Agent, or Firm*—Rapkin, Gitlin & Beaumont

(57) ABSTRACT

Motion picture film reel for holding, transporting and storing film comprising a pair of disc-shaped side retaining members and a central hub around which the film is wound. Each disc-shaped side retaining member is formed with a central hub engaging section with an annular projecting collar that defines a central primary opening for receiving a shaft and at least a single secondary opening that defines an appendage formed integrally therewith. A bendable prong, which extends from the central hub of each disc-shaped side retaining member normal to the plane thereof, includes a distal end and defines a slotted opening for engaging the appendage. A hub defines a central aperture for receiving the annular projection collar, a shaft and a pair of openings for receiving the bendable prongs, which are caused to pass through their respective openings and extend outwardly as the distal end of each prong engages an appendage. Each prong then recoils to a generally straight position to enable the slotted opening to retentively engage the appendage and secure all the components.

4 Claims, 3 Drawing Sheets

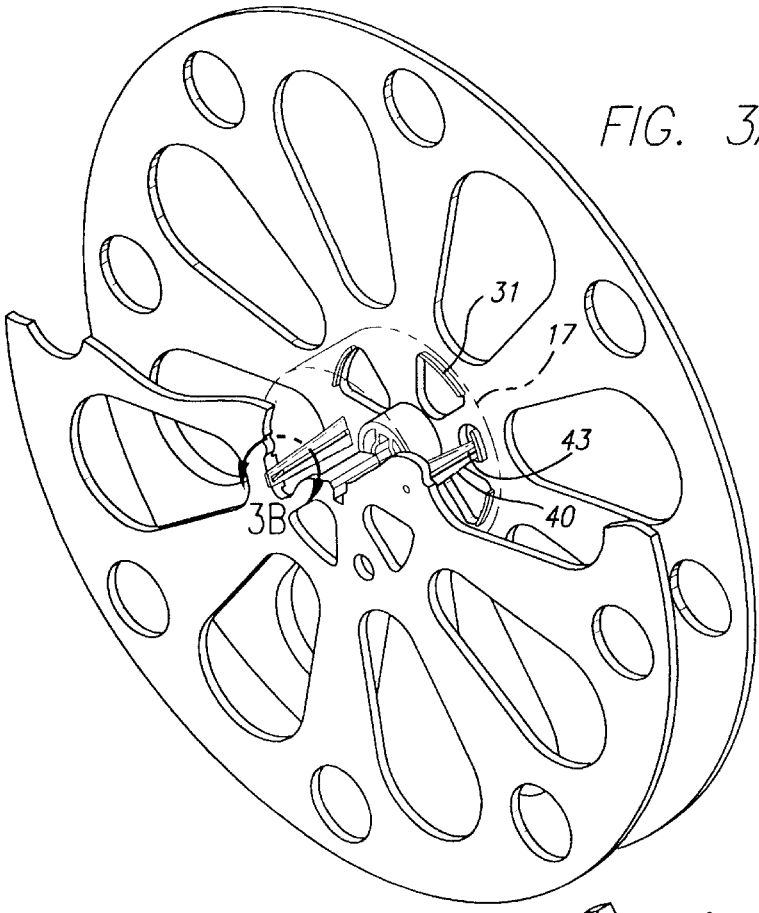
FIG. 3A
FIG. 3B
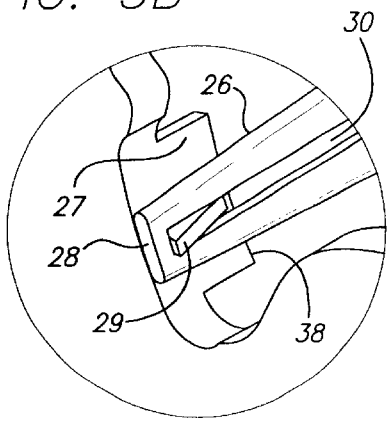
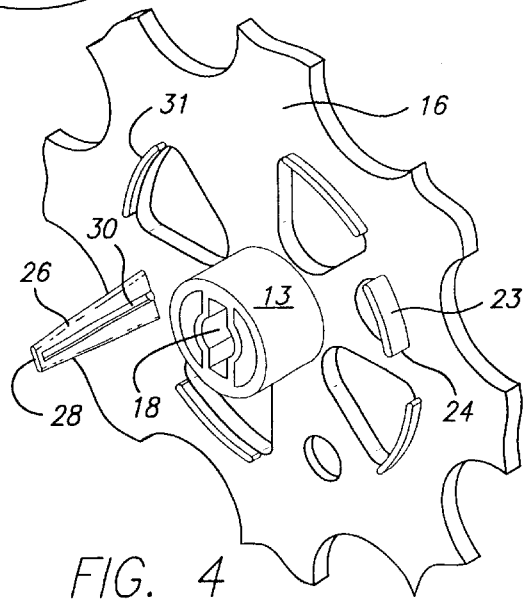
FIG. 4

FILM REEL

BACKGROUND OF THE INVENTION

1. Field of the Invention

The present invention relates generally to the field of motion picture film reels and more particularly to an improved mechanism to enable the main components of the film reel to more easily, efficiently and securely interlock.

2. Description of the Prior Art

In the past, motion picture film reels were used to transport film to and from movie theaters and similar exhibition venues. The reels were also used to protect and store the film. When the film arrived, the individual reels were usually installed on a rotating shaft powered by a motion picture projector, which projected the film images onto a screen. Now, when the film arrives at the theater, it is typically spliced and transferred onto a larger and usually horizontal "platter", which is used to feed the film through the projector.

Prior art reels were usually manufactured of metal and thereafter, as synthetic materials became more popular and economical, of resilient plastic. Normally, a reel is comprised of three components—two identical disc-shaped side retaining members and, in between the two side members, a separate core hub component around which the film is wound. Earlier versions of the reel often integrated the hub, or equal sections thereof, into the side retaining members.

Prior art film reels were secured using various devices, the earlier versions being non-separating and the later versions having the ability to separate. Separating versions required the three components to be screwed together, and latches and other suitable devices were employed to secure each disc-shaped side retaining member to the hub, usually through the center core, situated in between. When it was desirable to have immediate access to the film to remove it from the reel, or for any other purpose, the components, using an appropriate and required tool, were disengaged by either unscrewing them or releasing the latching or other mechanism to gain access to the film around the hub. However, the process of unscrewing or unlatching the components usually was extremely time consuming and often difficult and cumbersome depending upon the type of mechanism employed.

Stability has also been a problem with reel components secured by certain types of latching devices, particularly if the latch connections were made at or near the central area of the hub. Connections at or near the center of the hub give the side retaining members the character of a lever acting upon a fulcrum, i.e., the hub, thus providing added leverage to the side members to enable the members to more easily separate from the hub if an adequate outward (or even inward) force is inadvertently applied against either of them.

Accordingly, there is a need in the art to provide a film reel that includes resilient components and the two primary parts or side retaining members with the means to penetrate near or at the outermost sections of the hub to enable these members to interlock with each other without any physical connection to the hub. The improved film reel would be more stable than the prior art versions and easier and more efficient to securely interlock.

SUMMARY OF THE INVENTION

The present invention provides a motion picture film reel for holding, transporting and storing film comprised of a pair of disc-shaped side retaining members and a central hub around which the film is wound. Each of the disc-shaped side retaining members is formed with a central hub engaging section with an annular projecting collar, which defines a central primary opening for receiving a shaft, and at least a single secondary opening, which defines an appendage formed integrally therewith. A bendable prong extends from the central hub engaging section of each of the disc-shaped side retaining members normal to the plane thereof. Each prong has a distal end and defines a slotted opening for engaging the appendage.

A hub, which is also provided, defines a central aperture for receiving the annular projecting collars, and a shaft, and, at least, a pair of openings for receiving the respective bendable prongs. The prongs pass through their respective openings in the central hub and extend outwardly as the distal end of each prong engages an appendage. Each prong bends away from the appendage and then recoils to a generally straight position to enable the slotted opening to retentively engage the appendage.

Accordingly, an object of the present invention is to provide an improved film reel with components that are easy to engage and disengage.

Another object of the present invention is to provide an improved film reel with greater stability.

Another object of the present invention is to provide an improved film reel with components that can easily be connected and separated without the use of a tool.

Still another object of the present invention is to provide an improved film reel with components that are latched securely to prevent their accidental separation with the attendant possible damage to the film.

Still another object of the present invention is to provide an improved film reel with two side members and a separate hub wherein the side members interlock to secure the reel without having to make a physical connection to the hub.

"Still another object of the present invention is to provide an improved film reel which is easy and cost effective to manufacture."

Other objects and advantages of the present invention will become apparent in the following specifications when considered in light of the attached drawings wherein the preferred embodiment of the invention is illustrated.

BRIEF DESCRIPTION OF THE DRAWINGS

FIG. 3A is a sectional view of the present invention illustrating the manner in which the component parts of the reel are secured.

FIG. 3B is an enlarged detailed view of a section of the present invention shown in FIG. 3A.

FIG. 4 is a detailed perspective view of the hub engaging section of the present invention.

DETAILED DESCRIPTION OF THE PREFERRED EMBODIMENT

Figure 1:
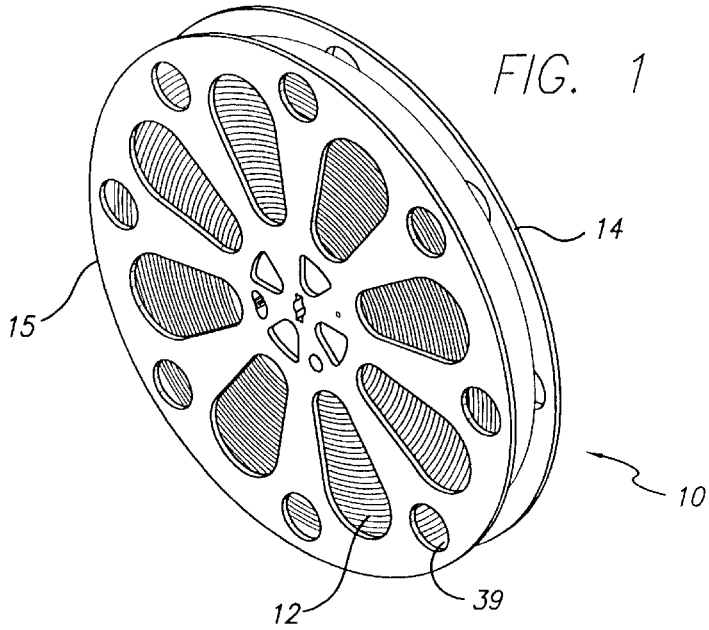
FIG. 1 is a perspective view of the present invention shown with the wound film.
Figure 2:
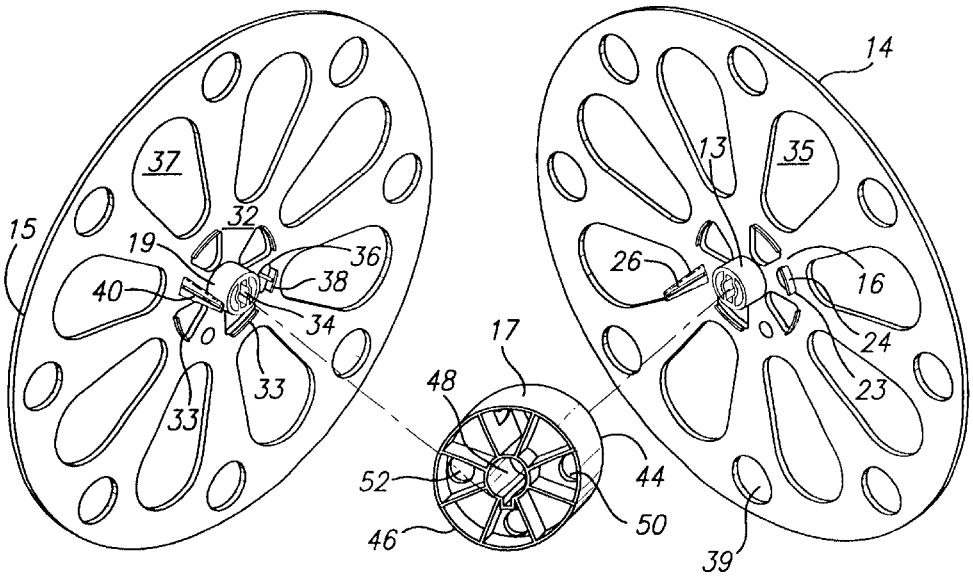
FIG. 2 is an exploded perspective view of the present invention illustrating its three components.
Figure 5:
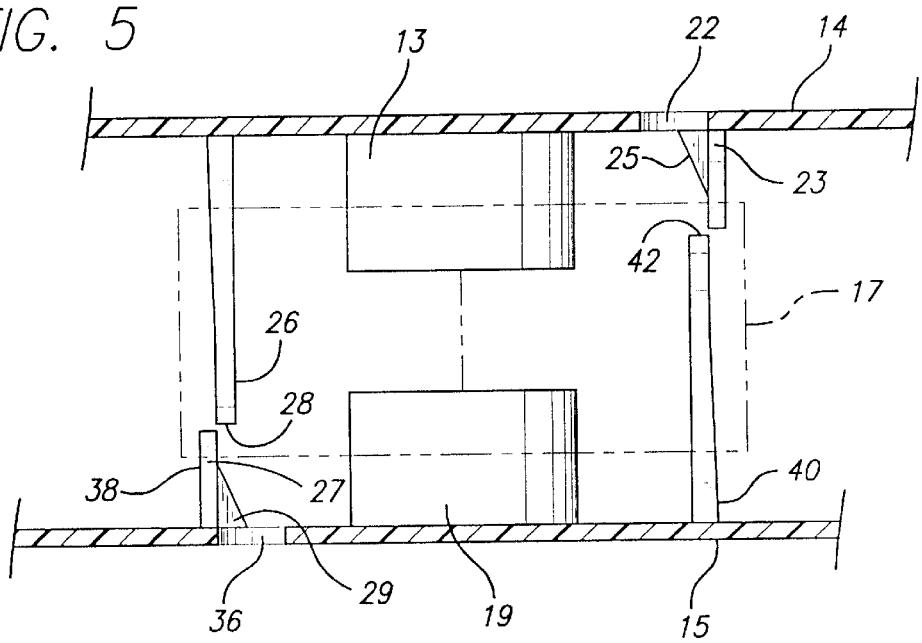
FIG. 5 is a sectional top view of the components of the present invention shown in the process of being engaged.
Figure 6:
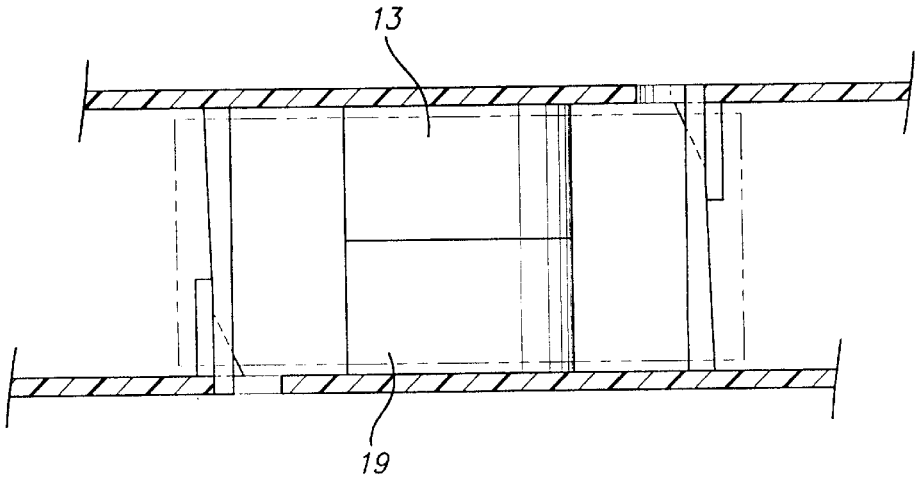
FIG. 6 is a sectional top view of the components of the present invention shown engaged and locked.

The preferred embodiment of the present invention, as shown in FIGS. 1 through 6, provides an improved motion picture film reel 10 for use in storing, holding and transporting motion picture film 12. Reel 10 comprises a first disc-shaped retaining member 14 and a second disc-shaped retaining member 15, which are provided to protect and retain the film in its wound format, and a hub member 17, which acts as a spacer and the component around which the film is wound.

"First disc-shaped retaining member 14 includes a first central hub engaging section 16 having an annular projecting collar 13, which defines a first central primary opening 18 for receiving a shaft (not shown), and secondary opening 22, which defines an appendage 24. Appendage 24 includes a generally vertical projecting wall 23 and tapered nose member 25 formed integrally therewith. Circumscribing first central hub engaging section 16 are a plurality of relatively elongated projecting flanges 31 to assist in mounting and securing hub member 17 between first disc-shaped retaining member 14 and second disc-shaped retaining member 15. A first bendable prong 26, which includes a distal end 28 and defines a slotted opening 30 for engaging the tapered nose member of the appendage of the other disc-shaped retaining member 16, extends outwardly from the first central hub engaging section 16."

"Second disc-shaped retaining member 15 includes a second central hub engaging section 32 having an annular projecting collar 19, which defines a second central primary opening 34 for receiving a shaft (not shown), and a secondary opening 36, which defines an appendage 38. Appendage 38 includes a generally vertical projecting wall 27 and tapered nose member 29 formed integrally therewith. Circumscribing second central hub engaging section 32 are a plurality of elongated projecting flanges 33 to assist in mounting and securing hub member 17 between first disc-shaped retaining member 14 and second disc-shaped retaining member 15. A second bendable prong 40, which includes a distal end 42 and defines a slotted opening 43 for engaging the tapered nose member 25 of appendage 24, extends outwardly from the second hub engaging section 32."

Hub member 17 includes opposing sides 44 and 46, central aperture 48 therethrough for receiving annular projecting collar 13, a shaft (not shown), and first opening 50 and second opening 52 for receiving first bendable prong 26 and second bendable prong 40, respectively.

"In practice, first bendable prong 26 and second bendable prong 40 are concurrently passed through first opening 50 and second opening 52, respectively. Prongs 26 and 40 then extend outwardly toward opposing disc-shaped retaining members 14 and 15, respectively. First bendable prong 26 and second bendable prong 40 are deflected outwardly and away from the appendages as their respectively distal ends 28 and 42 engage respective tapered nose members 29 and 25. Prongs 26 and 40 then recoil to a generally straight or upright position to enable the slotted openings 30 and 42 to retentively engage the appendages, specifically the respective tapered nose members 25 and 29, and secure the reel components. Usually, slotted openings 30 and 42 engage appendages 38 and 24 with a tell tale clicking or snapping sound, which indicates the connection is complete and the components are secure."

Openings 35 and 37 in first disc-shaped retaining member 14 and second disc-shaped retaining member 15, respectively, are provided to enable the observation of the amount of film wound on the reel, but otherwise are aesthetic features of the invention. Openings 39 are provided solely as an aesthetic feature.

The components of reel 10 are usually comprised of a resilient, synthetic material, such as common plastic. Other materials may also be suitable, including without limitation, metal alloys and natural materials, such as wood. Despite the material used, the characteristics that are most critical are weight, strength and resiliency.

While the invention will be described in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended claims.

What is claimed is:

1. A motion picture film reel for holding film comprising:

a first disc-shaped side retaining member having a first central hub engaging section with an annular projecting collar defining a first central primary opening for engaging a shaft, and a secondary opening, said secondary opening defining a first appendage, and a first bendable prong extending outwardly from the first central hub engaging section normal to the plane of said first disc-shaped side retaining member, said bendable prong having a distal end and defining a slotted opening;

a second disc-shaped side retaining member having a second central hub engaging section with an annular projecting collar defining a second central primary opening for engaging a shaft, and a secondary opening, said secondary opening defining a second appendage, and a second bendable prong extending outwardly from the second central hub engaging section normal to the plane of said second disc-shaped retaining member, said bendable prong having a distal end and defining a slotted opening, said slotted opening in the first prong engaging the second appendage and the slotted opening in the second prong engaging the first appendage; and, a hub member having opposing sides and defining a central aperture therethrough for receiving the annular projecting collar and a shaft, and a first opening and a second opening therethrough for receiving said first and second bendable prongs, respectively, wherein said first and second bendable prongs pass through said first and second openings, respectively, and extend outwardly toward opposing disc-shaped side retaining members, whereby said first and second bendable prongs are deflected outwardly and away from their respective appendages as the distal end of each said prong engages said respective appendages and recoils to enable said slotted opening to retentively engage said appendage and secure said side retaining members and the hub.

2. The invention of claim 1 wherein each said appendage comprises a protruding vertical wall integrally formed with a generally angular projection for deflecting and engaging said bendable prong.

3. The invention of claim 1, wherein each said central hub engaging section comprises one or more elongated projecting flanges to assist in mounting and securing the hub member between said first disc-shaped side retaining member and said second disc-shaped side retaining member.

4. A pair of disc-shaped side retaining members each formed with a central hub engaging section with an annular projecting collar defining a central primary opening for engaging a shaft, a secondary opening, an appendage integrally formed with said secondary opening, and a bendable prong, each of said prongs having a distal end and defining a slotted opening for releasably engaging said appendage of the other of the side retaining members; and, a hub member having opposing sides and defining a central aperture therethrough for receiving said annular projecting collar and a shaft, and openings therethrough for receiving said bendable prongs, wherein said bendable prongs pass through said openings for receiving said bendable prongs and extend outwardly toward opposing disc-shaped side retaining members, whereby said bendable prongs are deflected outwardly as the distal end of each said prong engages said respective appendage and recoils to enable said slotted opening to retentively engage said appendage.

* * * * *

UNITED STATES PATENT AND TRADEMARK OFFICE

CERTIFICATE OF CORRECTION

PATENT NO. : 6,702,228 B2
DATED : March 9, 2004
INVENTOR(S) : Larry M. Zide

It is certified that error appears in the above-identified patent and that said Letters Patent is hereby corrected as shown below:

Column 2,
Lines 33 and 35, delete the quotation marks.

Column 3,
Lines 1, 16, 17, 31, 37 and 52, delete the quotation marks.

Signed and Sealed this

Tenth Day of August, 2004

JON W. DUDAS
*Acting Director of the United States Patent and Trademark Office*